US005863390A

United States Patent [19]

Matsuno

[11] Patent Number: 5,863,390

[45] Date of Patent: Jan. 26, 1999

[54] PAPER MAKING FELT WITH PBO FIBER BATT LAYERS

[75] Inventor: Mitsuyoshi Matsuno, Kashiwa, Japan

[73] Assignee: Ichikawa Co., Ltd., Tokyo, Japan

[21] Appl. No.: 906,018

[22] Filed: Aug. 4, 1997

[30] Foreign Application Priority Data

Aug. 2, 1996 [JP] Japan ..... 8-220627

[51] Int. Cl.[6] ..... D21F 7/08

[52] U.S. Cl. ..... 162/358.2; 162/900; 162/902; 442/268; 442/414

[58] Field of Search ..... 162/358.2, 900, 162/902; 442/414, 268

[56] References Cited

U.S. PATENT DOCUMENTS 5,356,584 10/1994 Bubeck et al. ..... 264/205

FOREIGN PATENT DOCUMENTS 64-2100 6/1987 Japan .

OTHER PUBLICATIONS

*Japanese Journal of Fiber Association*, vol. 52, No. 3, pp. 143–147 (1996).

*Primary Examiner*—Karen M. Hastings
*Attorney, Agent, or Firm*—Howson Howson

[57] ABSTRACT

A paper making felt for use in hot press or press drying paper making processes comprising a base cloth layer and batt fiber layers, with at least the paper-contacting surface layer of the batt fiber layers composed principally of poly (paraphenylene benzoxazole) fiber. The felt exhibits a high degree of resistance to flattening, and consequently its effectiveness in removing water from the paper and its useful life for that purpose are enhanced.

2 Claims, 4 Drawing Sheets

FIG. 2
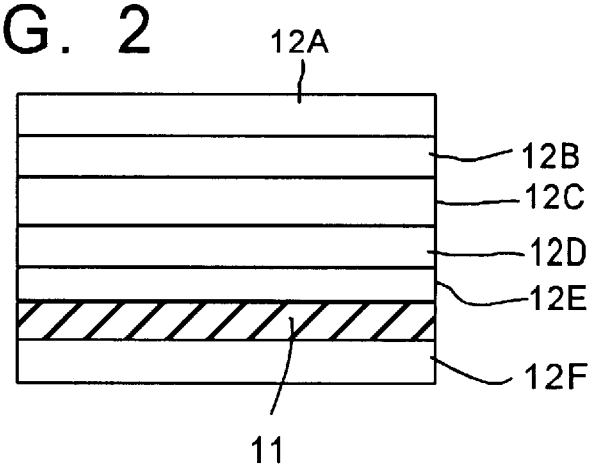
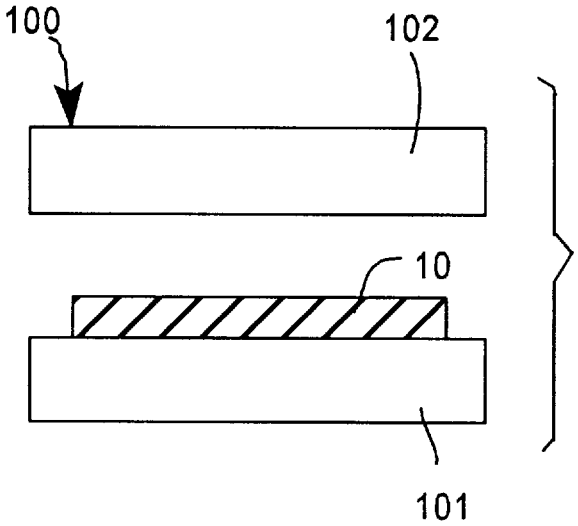
FIG. 3

| | Example 1 | Example 2 | Example 3 | Example 4 | Example 5 | Example 6 | Comparative Example |
|---|---|---|---|---|---|---|---|
| /2A | 100 | 100 | 100 | 100 | 75 | 75 | 0 |
| /2B | 100 | 100 | 100 | 75 | 75 | 50 | 0 |
| /2C | 100 | 100 | 50 | 50 | 50 | 50 | 0 |
| /2D | 100 | 75 | 50 | 50 | 50 | 0 | 0 |
| /2E | 100 | 75 | 50 | 50 | 25 | 0 | 0 |
| /2F | 100 | 50 | 50 | 50 | 25 | 0 | 0 |
| /Total amount of the batt fiber layers | 100.0 | 83.3 | 66.7 | 62.5 | 50.0 | 29.2 | 0.0 |

FIG. 4

| Sample | Felt Density after heat pressing ($g/cm^3$) |
|---|---|
| Example 1 | 0.498 |
| Example 2 | 0.521 |
| Example 3 | 0.603 |
| Example 4 | 0.628 |
| Example 5 | 0.732 |
| Example 6 | 0.786 |
| Comparative Example | 0.871 |

FIG. 5

PAPER MAKING FELT WITH PBO FIBER BATT LAYERS

SUMMARY OF THE INVENTION

This invention relates to paper making and more particularly to a felt for use in a paper making process wherein, in order to remove water from wet paper, the wet paper is passed, on a belt of felt, between a pair of rollers at the pressing stage of a paper making machine while being kept in contact with one of the rollers, which is heated.

Water can be squeezed from wet paper at room temperature in the pressing stage of a paper making machine. However, the efficiency of water removal is improved by the application of heat at the pressing stage using the so-called "hot press" method. In the hot press method, one roller of a pair of cooperating rollers is heated, generally to a temperature in the range of 100° C. to 150° C. Applying heat, while simultaneously pressing the paper between the rollers at a nip pressure in the range of 100 to 250 kg/cm for example, reduces the viscosity of the water in the wet paper, and improves the efficiency of water removal compared to the efficiency achieved at room temperature.

In another process, known as the "press drying" method, one of the rollers of the pair is heated generally to a temperature in the range of 150° C. to 250° C., and the nip pressure is in the range of 200 to 550 kg/cm$^2$. In the press drying method, the water in the wet paper is evaporated, with a resultant remarkable improvement in the efficiency of water removal.

It is known that either of these methods can improve the dryness of the paper after pressing.

Normally, when wet paper is passed between a pair of rollers, one of which is heated, the wet paper is in direct contact with the heated roller, while the felt on which the wet paper is carried is not in direct contact with the heated roller, and is only heated indirectly by conduction through the paper. However, when the wet paper is broken in the process of squeezing water from it, heat from the heated roller may be applied directly to the felt, causing damage to, or deformation of, the felt.

Because of concerns about the breakage of the wet paper in the water squeezing process, there has been a demand for a felt having sufficient heat resistance. Japanese laid-open Utility Model Application No. 2100/1989 describes a technique in which the surface layer of a dryer felt to be used in the drying stage of a paper making machine is prepared from meta-aramid fiber or paraphenylene sulfide fiber for improved heat resistance.

A problem encountered in prior heat-resistant dryer felts is that surface smoothness and air permeability are difficult to maintain, and decreases in smoothness and in air permeability have an adverse influence on the dry finish of the wet paper and on the life of the felt. Deterioration of the water squeezing property of the felt is also a problem. Such deterioration is characterized by heat deformation and flattening of the fibers of the felt, which becomes serious at high temperatures. The thermoplastic fibers mentioned above become deformed and flattened when subjected to high temperature and high pressure. The deformation and flattening of the fibers of a felt reduces their elasticity, which in turn results in a decrease in the water squeezing efficiency of the felt within a short time. Clogging of the felts can occur, even if the fibers are not melted or decomposed by heat.

A general object of this invention is to provide an improved felt for use in a paper making process wherein wet paper is passed, on the felt, between a pair of rollers at the pressing stage of a paper making machine while it is kept in contact with a heated roller of the pair. It is an important object of the invention to provide a novel felt which is capable of retaining stable elasticity over a long term of use. It is also an object of the invention to provide a paper-making felt which does not melt or deform even under conditions of high temperature and pressure.

I have discovered that a fiber bundle consisting of poly (paraphenylene benzoxazole) fibers (also referred to as PBO fibers) alone, or of which PBO fibers are the principal component, does not exhibit reduced elasticity even if repeatedly compressed under conditions of high temperature and pressure.

PBO fibers have a far better strength and elastic modulus than the conventional para-phenylene sulfide and aramid fibers, and PBO exhibits excellent heat resistance, including a higher thermal decomposition temperature and a reduced temperature-dependent change of elastic modulus. The properties of PBO fibers are described in a report in the Japanese Journal of Fiber Association, Vol. 52, No. 3, pp. 143–147 (1996).

Therefore, in accordance with the invention the foregoing objects are addressed by a felt comprising a base cloth layer and batt fiber layers, wherein at least the paper-contacting surface layer of the batt fiber layers is composed principally of poly(paraphenylene benzoxazole) fiber.

Furthermore, the batt fiber layers are composed of the paper-contacting surface layer and a plurality of individual layers underlying the paper-contacting surface layer. The individual underlying layers consist of a plurality of upper layers and a plurality of lower layers, the upper layers being nearer than the lower layers to the surface layer. In a preferred embodiment of the invention, the poly (paraphenylene benzoxazole) fiber content of the upper layers is higher than that of the lower layers.

The reason why at least the paper-contacting surface layer of the batt fiber layers is composed principally of poly (paraphenylene benzoxazole) fiber is as follows. The surface layer, when in contact with the wet paper where the wet paper is being introduced to the heat press rollers, is subject to heat and pressure from the heated roller conducted through the wet paper. On the other hand, less heat is conducted to the lower layers of the felt, and consequently the lower layers are at a lower temperature. Consequently, taking into account the temperature distribution through the thickness of the felt, the lower layers can be of a composition comprising a quantity of PBO fiber along with other fibers having a relatively low melting point or thermal decomposition temperature blended with the PBO fibers, so long as the blend reasonably meets the heat press conditions.

In the batt fibers, the fibers blended into the PBO fibers are preferably selected from those polyamide fibers, meta-aramid fibers and para-aramid fibers having a high melting point or a high heat decomposition temperature; aromatic polymer fibers with heterocyclic rings such as aromatic polyether amide, polybenzoimidazole (PBI) fibers and polyoxydiazole (POD) fibers, polyarylate (PAR) fibers; polycyanoacryl ether ketone fibers; polyether ketone (PEK) fibers; polyether ether ketone (PEEK) fibers; polyphenylene sulfide (PPS) fibers; and polytetrafluoroethylene (PTFE) fibers.

In accordance with the invention, therefore, a felt for paper making can be provided having remarkably improved elasticity and an improved flattening property at a high temperature and under high moisture conditions. Even in a process in which the temperature of the heated roller in contact with the wet paper is as high as 250° C., if, due to a break in the wet paper, the heat and pressure of the roller are applied directly to the felt, the felt can sufficiently endure the heat and pressure.

Other objects, details and advantages of the invention will be apparent from the following detailed description when read in conjunction with the drawings.

BRIEF DESCRIPTION OF THE DRAWINGS

FIG. 2 is an enlarged schematic cross-sectional view of a felt in accordance with the invention;

FIG. 3 is a schematic cross-sectional view of a plate heat press simulator for testing felts;

FIG. 4 is a table comparing the PBO fiber content of various felts in accordance with the invention with a comparative example, the PBO fiber content being expressed as a percentage of the total fiber content, by weight; and, FIG. 5 is a table showing the results of tests on the felts listed in the table of FIG. 4.

DETAILED DESCRIPTION

Figure 1:
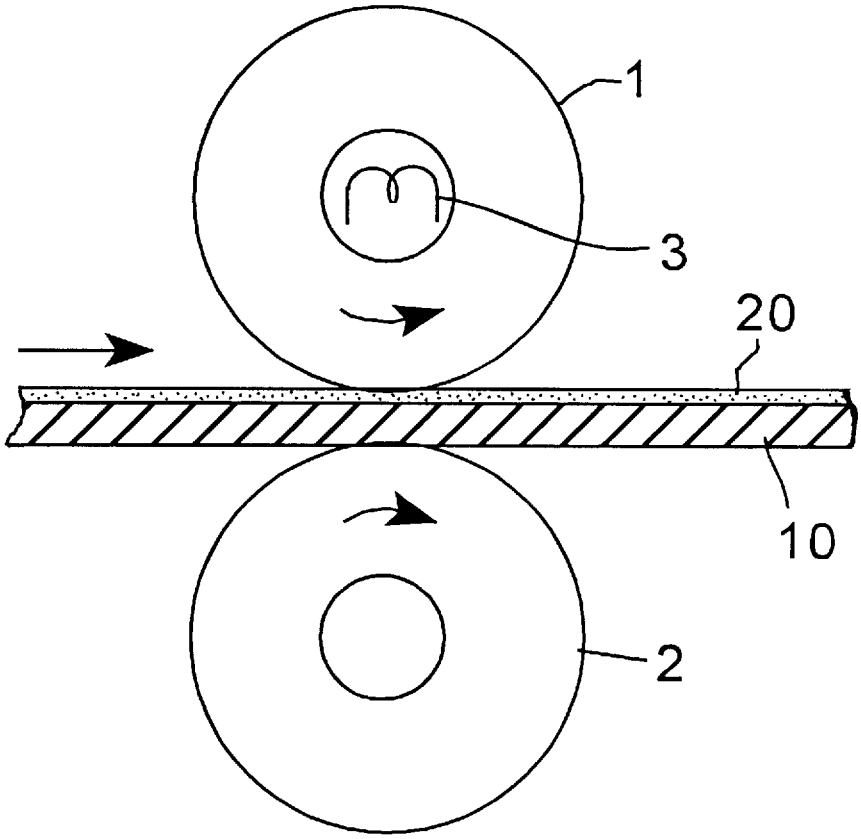
FIG. 1 is a schematic cross-sectional view depicting a pair of rollers at the press stage of a paper making machine, showing a felt carrying a layer of wet paper through the nip between the rollers.

In FIG. 1, rollers 1 and 2 are disposed on parallel axes at the press stage of a paper making machine. The upper roller 1 is heated by a heater 3. A felt 10, carrying wet paper 20, passes between the rollers, which apply pressure to the wet paper while the wet paper is heated by heat conducted directly from roller 1.

As shown in FIG. 2, the felt 10 is composed of a base cloth layer 11 and a plurality of batt fiber layers 12A–12F, there being five layers, 12A–12E, on the front (upper) side of the base cloth 11 and one layer, 12F, on the back (bottom) side of the base cloth. Each of the batt fiber layers has a uniform base weight. The batt fiber layers are secured to the base cloth layer and to one another by needle punching, each batt fiber layer being serially formed on the base cloth layer from the inner layer side thereof.

The principal component, that is from about 75% to 100% by weight, of the surface layer 12A of the batt fiber layers is poly(paraphenylene benzoxazole) (PBO) fiber.

Among the individual fiber batt layers 12A–12F, the PBO content of the upper layers is higher than the PBO content of the lower layers. More specifically, the PBO fiber content of the layers 12B–12F can decrease, progressing in the direction from layer 12A to layer 12F.

The wet paper 20 is in contact with the heated roller 1, as shown in FIG. 1, and the temperature of the heated roller depends on the method of squeezing being carried out. In the case of the hot press method, the roller is heated to a temperature in the range of 100° C. to 150° C., while in the press drying method, the roller is heated to a temperature in the range of 150° C. to 250° C.

Referring now to FIGS. 2 and 4, in Example 1, by a needle punching process, five layers of batt fiber 12A to 12E were filled onto the surface side of base cloth layer 11 and one more layer 12F was filled onto the opposite side of the base cloth layer. The base cloth layer comprises a double-textured fabric in which both the warp and the weft are composed of twisted yarn of polyamide fiber (e.g. Nylon 6). The PBO fiber content of the individual batt fiber layers was varied as shown in FIG. 4 to prepare six examples according to the invention and one comparative example. In examples 1–6, in each case polyphenylene sulfide (PPS) was used as the fiber to be blended into the PBO fibers. In the comparative example, each batt consisted entirely of PPS. Needle punching was carried out under the same conditions in each example.

In Example 1, which is a referential example, all of the batt fiber layers were composed of 100% PBO fiber. In examples 2 through 5, the PBO fiber content was relatively higher in the batt fiber layers at and near the surface, but the PBO content of the lower layers was reduced. In example 6, the lower batt fiber layers were composed of PPS fiber alone. In the comparative example, the bat fiber layers were composed of 100% PPS fiber.

Using the simulation apparatus depicted in FIG. 3, the felts of examples 1 through 6 and the comparative example were repeatedly compressed 100,000 times at 100 kg/cm$^2$, at a rate of once per second, between a bottom pressing plate 101 and a top pressing plate 102 heated to a temperature of 250° C. The density of each batt was measured after heat pressing, and the results are tabulated in FIG. 5.

As shown in FIG. 5, a larger number of batt fiber layers comprising PBO fibers alone on the surface of the felt keeps the felt density small after heat pressing, and thus improves the resistance of the resulting felts to flattening. When the PBO fiber is mixed with other fibers in a layer and the PBO fiber content is at least 25%, the felt density is also kept small after heat pressing, and therefor the felts are resistant to flattening. Particularly when the PBO fiber content is 50% or more by weight, the maintenance of a low felt density and resistance to flattening are remarkably enhanced.

As described above, the felt in accordance with the invention serves to pass wet paper between a pair of rollers at the pressing stage of the paper making machine, with the wet paper in contact with a heated one of the rollers. PBO fiber is the principal component of at least the surface layer, which is in contact with the wet paper. The PBO fibers prevent the felt from being thermally deformed even when the paper is pressed at high temperature, and cause the felt to retain stable elasticity. Thus the felt has significantly improved resistance to flattening.

In the case of a felt made up of a plurality of layers, where the surface layer in contact with the wet paper is principally made of PBO fibers, the underlying layers nearer the surface layer preferably have a higher PBO content than the underlying layers farther from the surface layer. With a felt so constructed, the influence of the heat conducted from the heated roller through the wet paper to the surface layer of the felt is effectively suppressed at and near the surface layer, and consequently common polyamide fibers can be blended into the PBO fibers in the lower batt fiber layers advantageously.

Various modifications can be made to the felt including modifications to the number of layers and in the compositions thereof. Still other modifications can be made to the apparatus and method described above without departing from the scope of the invention as defined in the following claims.

I claim:

1. An endless papermaking felt for use in a paper making process wherein wet paper is passed, on the felt, between a pair of rollers at the pressing stage of a paper making machine while it is kept in contact with a heated roller of the pair, the felt comprising a base cloth layer and batt fiber layers, wherein at least the paper-contacting surface layer of the batt fiber layers is composed of about 75% to 100% by weight poly(paraphenylene benzoxazole) fiber, and the batt fiber layers are composed of the paper-contacting surface layer and a plurality of individual layers underlying the paper-contacting surface layer, the individual underlying layers consisting of a plurality of upper layers and a plurality of lower layers, the upper layers being nearer than the lower layers to the surface layer, and wherein at least the upper layers contain poly(paraphenylene benzoxazole) fibers, and the poly(paraphenylene benzoxazole) fiber content of the upper layers is higher than the poly(paraphenylene benzoxazole) fiber content of the lower layers.

2. An endless papermaking felt according to claim 1 in which said lower layers include poly(paraphenylene benzoxazole) fibers and polyamide fibers blended into the poly(paraphenylene benzoxazole) fibers of said lower layers.

* * * * *

UNITED STATES PATENT AND TRADEMARK OFFICE

CERTIFICATE OF CORRECTION

PATENT NO. : 5,863,390

DATED : January 26, 1999

INVENTOR(S) : Mitsuyoshi Matsuno

It is certified that error appears in the above-identified patent and that said Letters Patent is hereby corrected as shown below:

At col. 4, line 17, replace "$kg/cm^2$" with --kg/cm--,

At col. 4, line 62, replace "on the felt" with --on a felt--,

Signed and Sealed this

Twenty-second Day of June, 1999

*Attest:*

Q. TODD DICKINSON

*Attesting Officer*

*Acting Commissioner of Patents and Trademarks*